United States Patent [19]

Kassakian

[11] 4,215,420

[45] Jul. 29, 1980

[54] PARITY SIMULATOR

[75] Inventor: John G. Kassakian, Newton, Mass.

[73] Assignee: Massachusetts Institute of Technology, Cambridge, Mass.

[21] Appl. No.: 886,222

[22] Filed: Mar. 13, 1978

[51] Int. Cl.[2] ..... G06G 7/63

[52] U.S. Cl. ..... 364/802; 324/73 AT; 364/489; 364/495; 364/578; 364/602

[58] Field of Search ..... 364/802, 801, 602, 600, 364/492, 495, 578, 491, 489, 715, 300; 324/158 R, 158 SC, 158 T, 73 R, 73 AT

[56] References Cited

U.S. PATENT DOCUMENTS

| | | | |
|---|---|---|---|
| 3,808,409 | 4/1974 | Enns | 364/578 X |
| 3,832,533 | 8/1974 | Carlson et al. | 364/578 X |
| 3,863,270 | 1/1975 | Haley et al. | 364/802 X |
| 4,042,830 | 8/1977 | Kellenbenz et al. | 364/578 X |

OTHER PUBLICATIONS

Kassakian et al. "Parity Simulation of Static Power Conversion Systems", Electric Power Systems Engineering Laboratory, Massachusetts Institute of Technology, Cambridge, Mass.

*Primary Examiner*—Joseph F. Ruggiero

*Attorney, Agent, or Firm*—Arthur A. Smith, Jr.; Robert Shaw

[57] ABSTRACT

An analog/digital simulator exhibiting a high degree of parity between the topology of the model and the topology of an electrical network being modeled. The simulator employs a plurality of synthetic electrical elements interconnected to simulate the electrical network; the synthetic electrical elements have terminals with which are associated physical voltages and physical currents that serve as a basis for network analysis.

20 Claims, 18 Drawing Figures

5msec/div

Actual Circuit 0.5 sec/div

Simulation

10v/div

1v/div $V_o$

.5msec/div

Actual Circuit

50msec/div

Simulation

50mA/div

5mA/div $I_1$

10v/div 0.5msec/div

Actual Circuit

1v/div

50msec/div

Simulation $V_{Q_2}$

10v/div 0.5msec/div

Actual Circuit

1v/div

50msec/div

Simulation $V_c$

PARITY SIMULATOR

The present invention relates to simulators employing analog/digital techniques.

Attention is called to a paper entitled "Parity Simulation of Static Power Conversion Systems" (Kassakian et al), Power Electrical Specialists Conference Record, pp. 324–328, June, 1977, Palo Alto, Calif., IEEE Publication 77-CH 1213-8 AE8; that discloses concepts of the present inventor and that is drawn upon heavily hereinafter.

The power circuits of static conversion systems are deceptively simple when compared with circuits comprising linear, small signal processing systems such as communications equipment. The behavior of the latter, however, yields to a theoretical analysis based on certain simplifying assumptions, the foundations of which are well established. Static power conversion systems, on the other hand, rarely can be satisfactorily analyzed, except under the simplest and least interesting conditions. The analysis problem is particularly intractable when one addresses the issue of dynamic behavior resulting from control system interactions or anomalous operating conditions. In such cases, one must resort to the use of models. These models can assume many forms, among which are the physical breadboard, the digital computer, the analog computer, and the hybrid computer, the latter being a composite of the previous two. Which particular approach is selected depends upon the previous experience of the investigator, the facilities available, and the nature of the problem.

Of the four approaches to modeling cited above, the breadboard is perhaps the most commonly employed. Often it consists of simply building the system, sometimes to scale, and experimenting until desirable (or acceptable) operation is obtained. Because of the rather unforgiving nature of power electronic systems, breadboarding is the least flexible of all existing simulation approaches, and provides the least insight into the margins for reliable operation and operational behavior under unusual system conditions. The advantage of the breadboard approach is that it requires no special facilities except patience and a good supply of devices.

In principle, the digital computer is the ideal vehicle for model studies. Indeed, digital simulations of complex "quasi-linear" systems have been highly successful in predicting the response of circuit behavior to perturbations in element values, caused, for instance, by radiation. As a practical matter, however, the digital computer has been inflexible and expensive when applied to systems employing numerous switching elements, each of which causes a change in system topology. Its principal advantage is its availability.

The problem is usually solved on the digital computer by establishing a set of state equations of the form $$[X]=[A][X]+[B][U] \quad (1)$$

describing the response of each possible topological state of the circuit. This set of equations is then integrated to obtain the desired response. The system state will change when a particular, predetermined condition of state variables exists. The program must check for these conditions at frequent intervals and respond by establishing the new set of state equations. If the number of possible states is small enough, the state equations may be obtained a priori and entered as part of the network data. More complex systems are often treated by employing a non-linear resistor as the switching element. This approach has the advantage of providing a constant topology system, but runs the risk of introducing arbitrarily small time constants which can cause problems with numerical integration routines if not treated properly—a general problem of solving stiff systems numerically. A large inductance in series with the resistor in the off state solves the stiffness problem but prevents one from modeling reverse recovery current.

An alternate approach to integrating the state equations directly is to formulate the solution for each state in terms of the network A-matrix. Under appropriate assumptions, particularly linearity, the response may be expressed rather simply in terms of the $e^{At}$ matrix. In this case, there may be an increase in computational efficiency over the straightforward integration of the state equations. However, the overhead associated with the desired topological and interactive flexibility is the same for both approaches.

The analog computer and its hybrid extension have been successfully employed in the simulation of static conversion systems by a number of researchers. The analog approach is similar to the digital approach in that both require the network to be formulated as a system of state equations. Digitally the equations are numerically integrated whereas the analog computer uses operational amplifiers to perform the integrations. The interconnections of analog components, done manually via a patch board, bears no correspondence to the original system topology. The impossibility of topological correspondence becomes apparant when one realizes that in the simulation, state variables are all represented by node voltages, whereas in the actual network the state variables are a combination of node voltages and branch currents. The result is a model in which it is extremely difficult to incorporate topological changes, thus limiting its usefulness as a design tool.

The modeling of switching elements on the analog computer generally requires the artifice of a small inductance in series with the switching device to transform the branch current into a state variable. Even for systems of moderate complexity, the number of analog elements required in the simulation becomes quite large relative to the number generally available. Certain assumptions can be made regarding the periodic nature of the response in order to minimize components, but such assumptions restrict the model's usefulness, particularly with respect to unbalanced operation of polyphase systems.

The parity simulator of the present invention presents a new approach to the modeling and simulation of static power conversion systems. This new approach, called "parity simulation", is designed specifically for that class of circuits employing switching elements such as diodes, transistors and thyristors, for the processing of electrical power. There is one-to-one correspondence, or "parity" between the circuit topology of the system being modeled and the topology of the interconnected model. Whereas the traditional modeling approaches are rather inflexible with respect to changes in system topology and limited in their interactive capabilities, parity simulation is designed to provide a high degree of investigator interaction and the ability to change element values or circuit topology with relative ease. The model thus becomes virtually an interactive design tool, providing immediately the effects of changes in circuit values, topology, control algorithms and parameters and the introduction of parasitic elements.

Accordingly, it is an object of the present invention to provide a novel approach to simulation of electrical networks.

Another object is to provide a novel approach to simulation of power networks.

Still another object is to provide a simulator that employs analog and digital circuitry in a way that permits great flexibility in the analyzing function.

A further object is to provide a simulator to model electrical networks containing semiconductor switches.

A still further object is to provide a simulator that exhibits 1:1 correspondence between the topology of the modeled network and the topology of the simulation.

These and still further objects are addressed hereinafter.

The foregoing objects are achieved, generally, in a simulator that includes, in combination, a plurality of synthetic electric elements interconnected to model an electrical network; the elements have electrical terminals with which are associated physical voltages and physical currents; and the elements are interconnected to produce a model which is topologically equivalent to the modeled network. The elements typically are a combination of passive and active elements and include both analog and digital units. A computer serves to effect appropriate circuit interconnections to model the network and changes therein, for example, to optimize the network operation in some particular.

The invention is hereafter described with reference to the accompanying drawing in which.

Turning now to the figures, the simulator shown in block diagram form at 101 in FIG. 1 serves to model an electrical network such as, for example, the current commutated chopper marked 110 in FIG. 2 and hereinafter discussed, which chopper contains semiconductor switches. The simulator 101 includes a plurality of synthetic electrical elements in the block marked 107; the synthetic electrical elements have electrical terminals and have associated with these terminals physical voltages and physical currents, the synthetic elements being interconnected to produce a model that is topologically equivalent to the modeled network. The synthetic elements are discussed in detail hereinafter, but a few general matters are noted here.

Each synthetic element of the plurality thereof has its own isolated electrical power supply, allowing the elements to be interconnected without regard to common ground. The principal operational components of the synthetic elements are active electronic devices such as operational amplifiers, transistors and voltage regulators, as well as multiplying digital-to-analog converters that serve to establish the values of the synthetic elements. A digital computer 102 in FIG. 1 is connected to control the value of each synthetic element. Further facets of the synthetic elements are taken up later; there now follows a more general description of the invention.

The power circuit part of static power conversion systems that may be modeled by the simulator 101 generally consists of a relatively small number of discrete elements. This power circuit part is then embodied in a control system incorporating both digital and analog components. If one addresses systems of this class, rather than the global problem of general circuit modeling, a very powerful model can be constructed. Parity simulation does this by providing a hybrid model in which the power circuit, containing all the switching elements, is modeled using synthetic element modules, and the control subsystem is simulated, for the most part, on a microprocessor-based minicomputer. The minicomputer also provides simulation control, data processing, and interactive graphics.

The power of the parity system results from the flexibility provided by the correspondence between the system and model topologies. This not only allows rapid and efficient programming, but also permits topological changes to be incorporated in a straightforward manner. The element modules consist of electronic analogs whose terminal characteristics are described in terms of voltage and current. In this sense, they differ from the conventional analog computer elements in which all circuit variables are represented by voltages. Typically there are modules to model inductors, capacitors, resistors, thyristors, and switching transistors. Three models, an inductor model, a capacitor model, and a thyristor model, are given as examples, herein.

Figure 1:
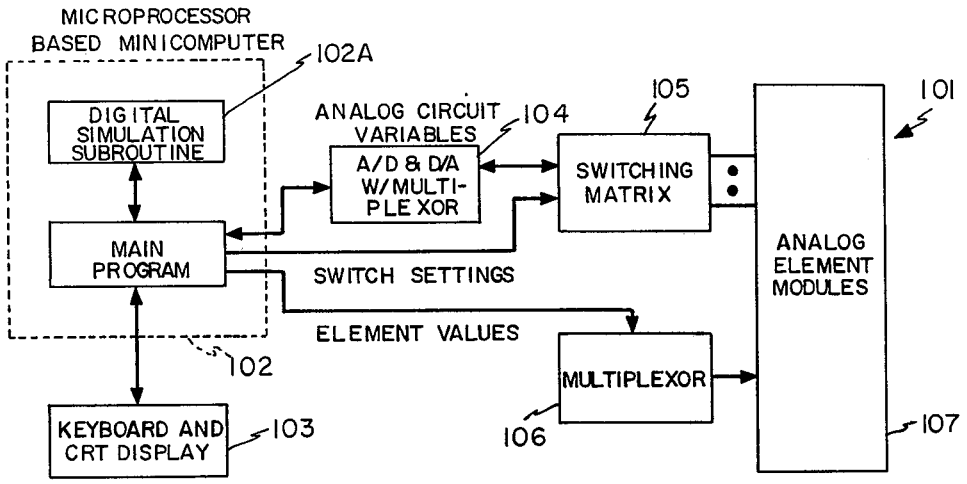
FIG. 1 is a block diagram representation of a parity simulator of the present invention.

The main parts of the system 101 in FIG. 1 are the minicomputer 102 and the element modules 107. Operator instruction is through a CRT display and keyboard 103. Digital control of the element values allows the computer 102 to calculate the scaled element values from specified scale factors as well as to change the element values for performance optimization. The circuit is wired by the computer using a switching matrix 105 via instructions from keyboard 103. The circuit schematic can then be graphically displayed and interacted with in a manner analogous to that employed with a traditional breadboard: branch currents or node voltages can be observed, element values can be changed, and elements can be added or removed. Unlike the breadboard, however, fault conditions and failure modes can be investigated in a nondestructive fashion. There is also the possibility of including in the simulation digital models for components such as machines. These digital models are contained in the digital simulation subroutine block 102A of FIG. 1. Thus, the variety of components that may be included in a simulation is greatly increased.

The size of the system modeled on the parity simulator 101 is virtually unlimited, the biggest problem being the automated interconnection matrix 105. Because of the topological parity, there is a 1:1 correspondence between the number of elements in the actual system and the number of elements in the simulation. In the conventional analog computer, this ratio is generally considerably greater than 1 and the number of available components is limited by the size of the patchboard.

The real time digital computer interface makes possible the digital modeling of certain system elements, such as rotating machines. Since these elements can be described by a single set of state equations for the entire duration of the simulation, a digital implementation poses no obstacle. The particular computer used, of course, will determine what limitations must be imposed on such digital models. The digital/analog interaction in the parity simulator includes all the capabilities of the conventional hybrid simulator with the important additional feature that elements can be added or removed during an automated system investigation. In the conventional hybrid simulator such topological changes must be anticipated and the patchboard wired accordingly. This capability makes the parity simulator, in concept, a powerful vehicle for the development of "intelligent" computer aided design or parameter optimization algorithms.

There are presently five types of synthetic element modules available in the parity simulator: inductor, capacitor, resistor, thyristor, and diode. Except for the thyristor, these are two terminal modules through which a physical current may flow. The thyristor differs in that it is a three-terminal device. All elements with a value parameter incorporate multiplying digital-to-analog (DAC) converters which allow the element values to be set digitally. Element values can be chosen over a range of five decades. By incorporating decade switching with the multiplying DAC, an element value resolution of 1% is achieved. The digital control of element values allows great flexibility in introducing nonlinear elements such as saturating magnetic circuit.

The thyristor model evaluates terminal conditions and makes a decision regarding the state of a reed relay. Holding current and reverse recovery characteristics are modeled, the latter depending on $dI_F/dt$, $I_{Fmax}$ and base lifetime. Other parameters such as on-state voltage, on-state resistance, and turn-on delay could easily be modeled if important to the operation of the circuit being simulated. Models for coupled magnetic circuits have been designed and implemented.

Figure 2:
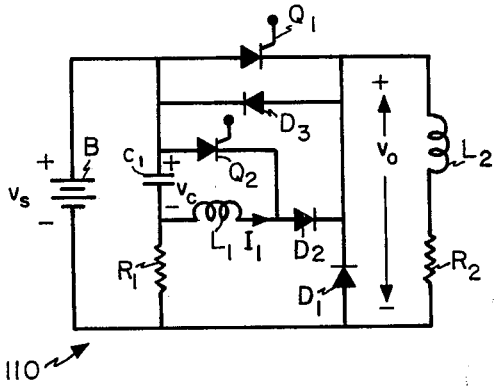
FIG. 2 is a schematic circuit representation of a current commutated chopper simulated in accordance with the present teachings.

The current commutated chopper circuit labeled 110 in FIG. 2 is used to illustrate the concept of parity simulation. The circuit 110 yields to an uncomplicated theoretical analysis and exhibits interesting behavior of certain variables during the commutation interval. Since it contains five switching elements, the circuit 110 has $2^5=32$ possible states which must be considered. Although in this case many of these states can be eliminated a priori, in a general case, such a priori knowledge cannot be assumed. In the parity simulation, no determination of possible states need be made since the synthesized switching elements will automatically establish the circuit states as do their counterparts in the actual network. Although the analog computer operates this way in principle, the user must first guarantee that his analog topology is algebraically explicit for each state.

The element values in the simulation are chosen by scaling the maximum voltage and current values to within the maximum values allowed by the parity simulator which are 10 V and about 50 mA, respectively. The time scaling factor is then chosen so that the maximum frequency in the model is within the bandwidth of the element modules. In this case, the voltage and current were both scaled down by a factor of ten and the time base was expanded by a factor of one hundred.

The current commutated chopper 110 consists of a battery B, thyristors $Q_1$ and $Q_2$, diodes $D_1$, $D_2$ and $D_3$, resistors $R_1$ and $R_2$, capacitor $C_1$ and inductors $L_1$ and $L_2$. The battery voltage is $V_s$, the voltage across the series inductor $L_2$ and $R_2$ is $V_o$ and $I_1$ is the electric current in $L_1$. The values applied to the circuit elements are: $C_1=2\ \mu F$, $L_1=10$ mH, $L_2=4$ H, $R_1=1.5\ k\Omega$, $R_2=300\ \Omega$, and $V_s=22$ volts.

FIGS. 3A–3H show various circuit variables as measured in the actual chopper depicted by the schematic of FIG. 2 and its parity simulation, FIGS. 3A, 3C, 3E and 3G being actual measured values for the circuit of FIG. 2 and FIGS. 3B, 3D, 3F and 3H the respective simulated values. Although both current and voltage variables are shown, in the simulation they all result from voltage measurements since somewhere in each synthetic element there is a voltage proportional to the current flowing through the element. This is particularly convenient for instrumentation purposes. Of course, the parity concept also permits the use of a current probe if desired.

The detailed correspondence of the waveforms of FIGS. 3A–3H is impressive. The value and power of the simulation lies, however, in the ability to change element values or circuit topology with great facility, thereby allowing a thorough investigation of a wide range of operating conditions with the inclusion of elements to simulate parasitic effects. Parasitic effects such as ringing during a switching transient, generally create a stiff system which must be treated explicitly with digital simulation approaches. The stiffness of a system is of no consequence to a parity simulation as long as the frequency of oscillation is inside the bandwidth of the synthetic elements, about 10kHz. The components used in the simulation resulting in FIGS. 3A–3H can accommodate a pole disparity of about four orders of magnitude. Rather commonplace operational amplifiers were used in synthesizing the elements and higher performance devices could accommodate systems of greater stiffness. To give this issue some meaning in the context of static conversion systems, one might note that the incorporation of snubber dynamics in a simulation is generally a difficult problem because of the stiffness which it introduces. Actual synthetic elements to represent the circuit elements are discussed below.

Parity simulation has been shown to be a powerful and versatile alternative to the use of analog or digital computers for the purpose of studying the behavior of static power conversion systems. Stiff systems can be accommodated with no difficulty. Simulation control via digital computer allows the user to perform parameter optimization, sensitivity, and failure mode studies with considerable facility, as well as providing great flexibility in input/output control. Digital control of element values also provides a powerful means for the modeling of nonlinear elements. Three examples of synthetic elements are given below for illustrative purposes. In the figures representative of these examples, some types of circuit elements actually used in test apparatus are labeled such to place this explanation in context. Some circuit element designations represent the element but also represents magnitude: thus, the label $R_A$ represents a resistor in FIG. 4B as well as the magnitude of that resistor in equations 4 and 5 below.

Figure 4A:
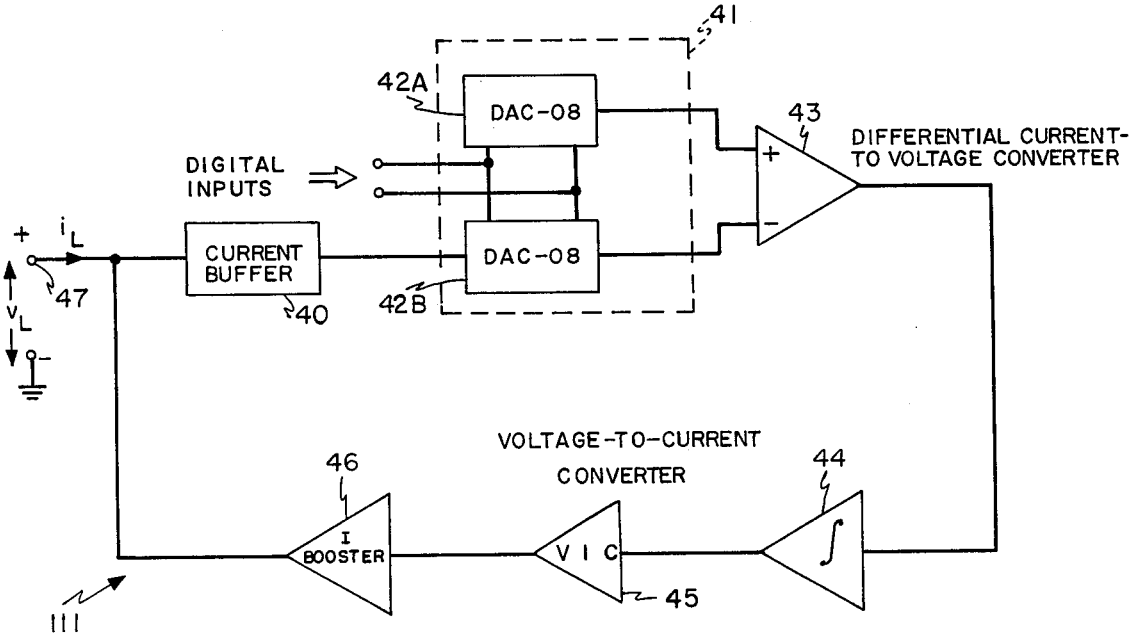
FIG. 4A is a block-diagram representation of a synthetic inductor.
Figure 3A:
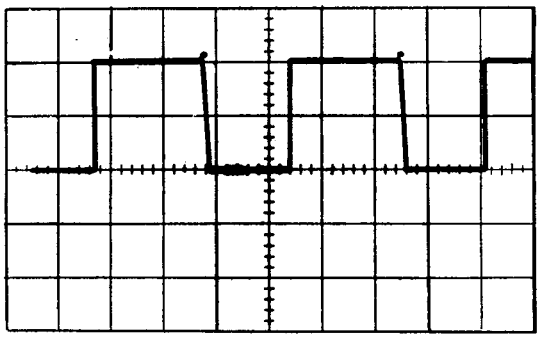
FIGS. 3A, 3C, 3E and 3G represent measured values in the chopper of FIG. 2, and FIGS. 3B, 3D, 3F and 3H respectively represent simulated values.
Figure 3B:
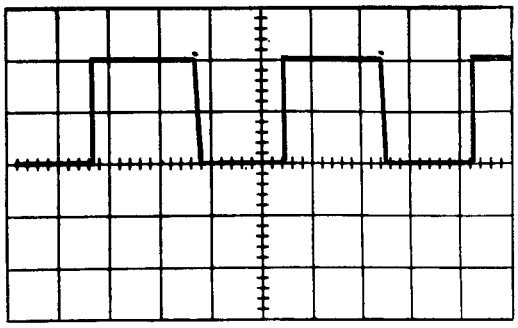
Figure 3C:
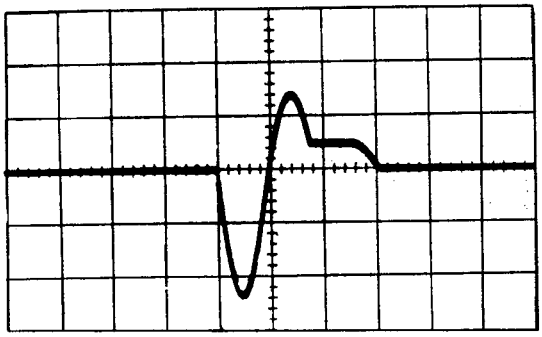
Figure 3D:
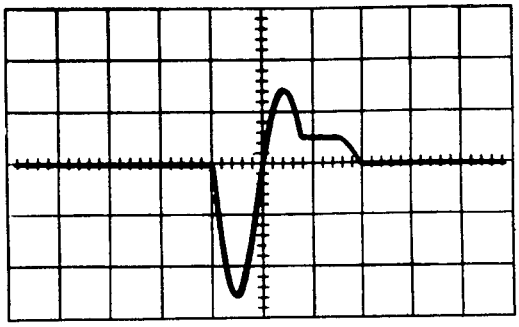
Figure 3E:
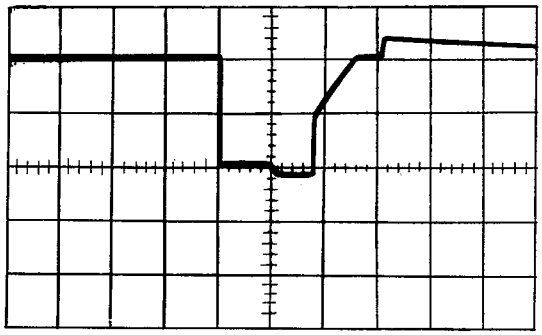
Figure 3F:
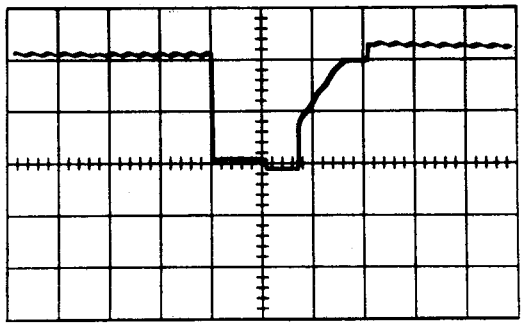
Figure 3G:
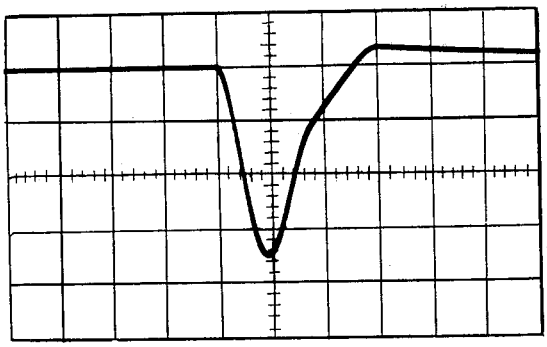
Figure 3H:
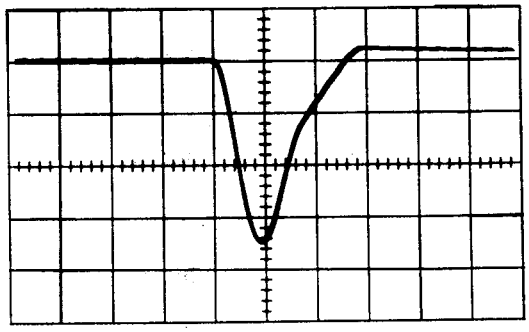
Figure 4B:
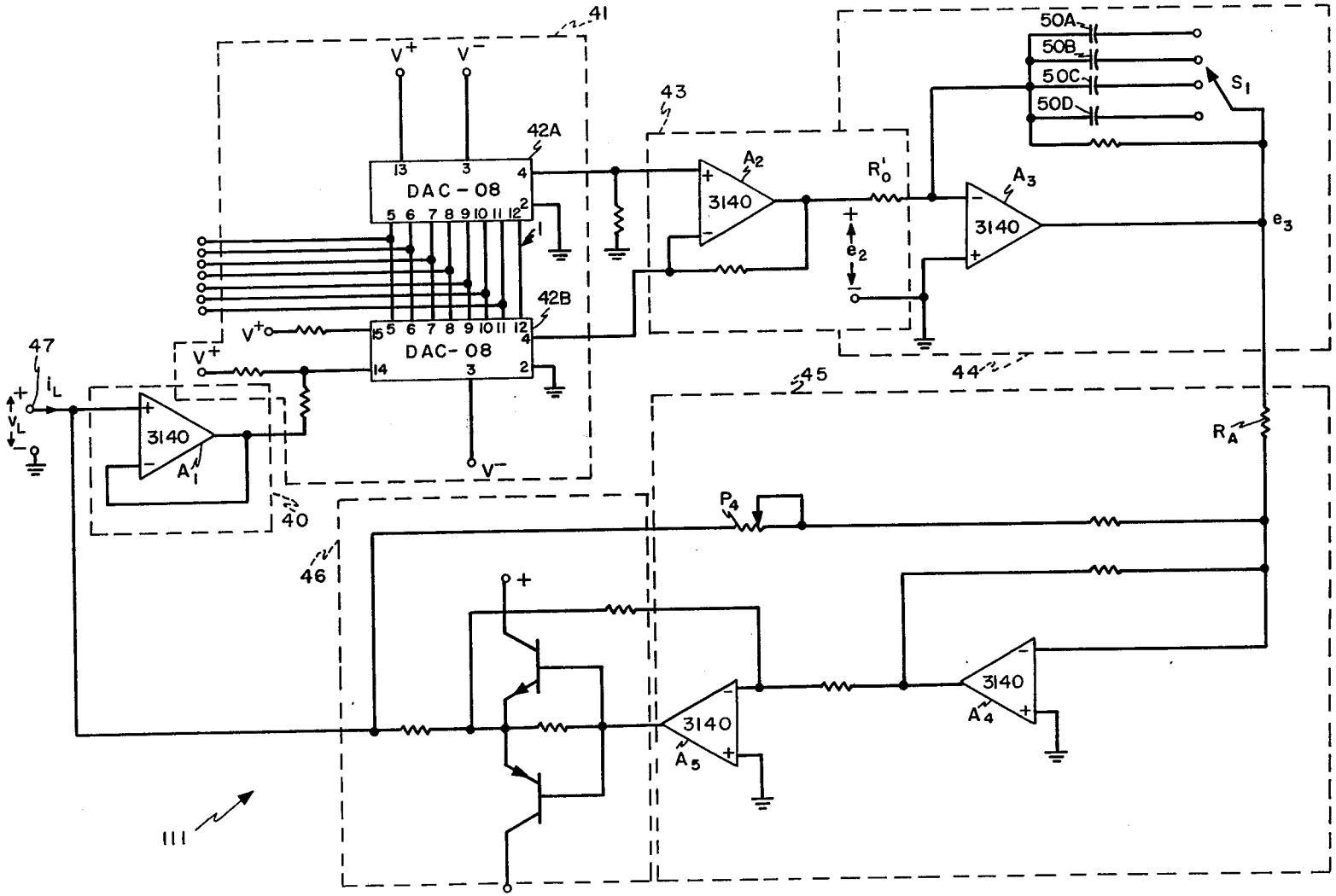
FIG. 4B is a schematic representation of the synthetic inductor of FIG. 4A.

A synthetic inductor is shown at 111 in block diagram form in FIG. 4A and schematically in FIGS. 4B; the inductor 111 has an inductance of value L which is determined by an equivalent capacitance $C_o$, and equivalent resistance $R_o$. The capacitance $C_o$ is established by switching capacitors 50A . . . in FIG. 4B into or out of the circuit by a switch $S_1$ which may be a reed relay of the type later discussed with reference to FIG. 6A. The equivalent resistance $R_o$ is a little more complex; it is a composite that is attained by adjusting circuit elements in the blocks marked 41 and 43 in FIGS. 4A and 4B. FIGS. 4A and 4B are now discussed in greater detail; only so much of the schematic circuit elements of FIG. 4B are needed for a clear understanding of the system are taken up.

The capacitance equivalent $C_o$, as indicated, is changed in decades, by switching in "decade increment capacitors" using computer controlled reed relays. Digital control of the resistance equivalent $R_o$ is achieved by using a pair of multiplying DACs 41 (Digital-to-Analog Converters) as a programmable attenuator preceeding a fixed resistor $R_o'$ in FIG. 4B.

FIG. 4A illustrates the functional block diagram of the digitally programmable inductor 111. A current buffer 40 prevents loading between an input signal $i_L$ at 47 and the DACs 41. The DACs, which are programmed by the computer, produce an output current which is transformed to a voltage by a differential I–V converter 43. An integrator 44, a voltage to current converter (VIC) and a current booster 46 combine to produce a current $i_L$ proportional to the voltage shown at $V_L$ in FIG. 4A, that is, the current voltage relationship of an inductor. The combined effect just noted is accomplished in this way. The output of the differential current to voltage converter 43 is integrated with time by the integrator. The output of the integrator 44 is converted to a current signal by the voltage-to-current converter 45 whose current output is, in turn, amplified to a useful level by the current booster 46. This current then forms the synthetic element terminal current $i_L$ which is now proportional to the integral of the terminal voltage $V_L$ as is exhibited by an actual inductor.

To appreciate the operation of this model, each of the fundamental decision blocks are separately analyzed below with reference to FIG. 4B, with special emphasis on the digital/analog section.

To prevent undesired interactions or loading effects between the input signal and the DACs 41, an op-amp $A_1$ (e.g., an internally compensated type 3140) in FIG. 4B is used as a voltage follower. The advantage of this follower is that it provides impedance buffering, that is, high input impedance and low output impedance. The internally compensated type 3140 op-amp used here serves quite effectively as an input buffer stage, providing high impedance isolation for the DACs.

To interface between the digital minicomputer 102 in FIG. 1 and the analog inductor module 111, a pair of multiplying digital-to-analog converters (DACs) 42A and 42B, are used (i.e., the two blocks labeled DAC-08 in FIGS. 4A and 4B). The DAC-08 is a multiplying eight-bit monolithic DAC which functions as a gain programmable amplifier and produces an output current which is a product of an input reference current $i_{ref}$ and a digital number obtained from the control computer. The programmed gain of this amplifier is designated [A]. The voltage $e_2$ in FIG. 4B is related to $V_L$ by $$e_2 = -1/5[A]V_L \tag{2}$$

The analog integrator 44 uses an op-amp $A_3$ in the inverting configuration as shown in FIG. 4B. Assuming ideal operation, the transfer function relating $e_3$ in FIG. 4B to $e_2$ is given by $$e_3 = -\frac{1}{R_o' C_o} \int e_2 \, dt \tag{3}$$

The VIC 45 of FIG. 4B uses two op-amps $A_4$ and $A_5$ and the current buffer 46 to drive a current into a grounded load. Precision high stability resistors are used for accurate voltage-to-current conversion. Stability adjustment is obtained by adjustment of a potentiometer $P_4$. The transfer function is given by $$i_L = (e_3/2R_A). \tag{4}$$

where $R_A$ is the resistor so labeled in FIG. 4B. Combining equations 3 and 4 gives for the synthetic inductor 111, an inductance value, L, of $$L = (10R_o'R_AC_o/[A]) \tag{5}$$

Parity Simulator Capacitor Model

Figure 5A:
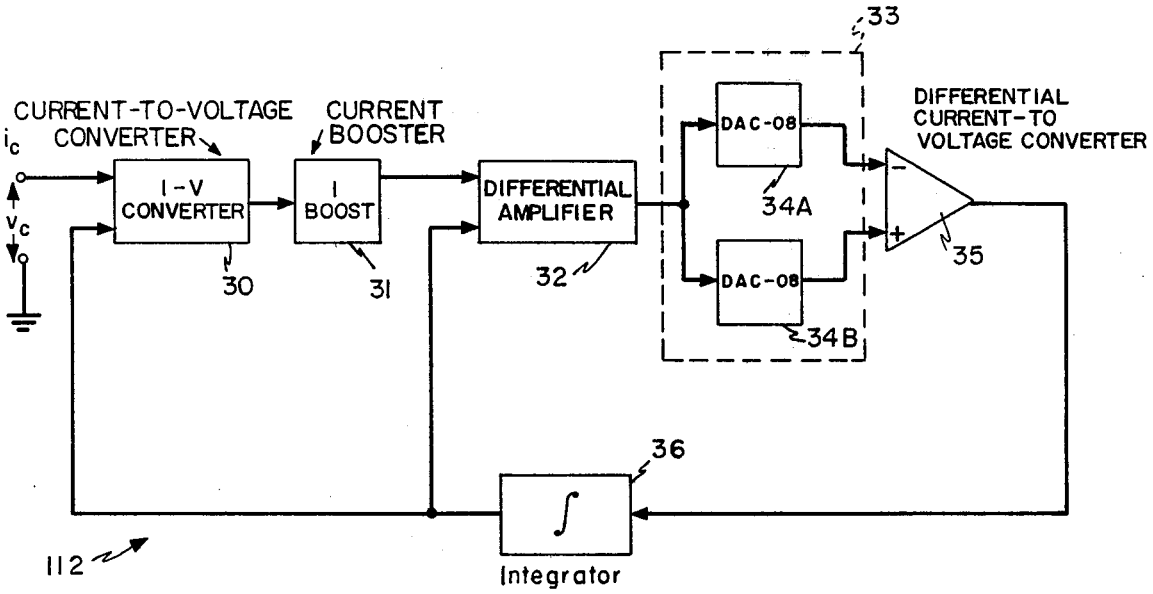
FIG. 5A is a block-diagram representation of a synthetic capacitor.
Figure 5B:
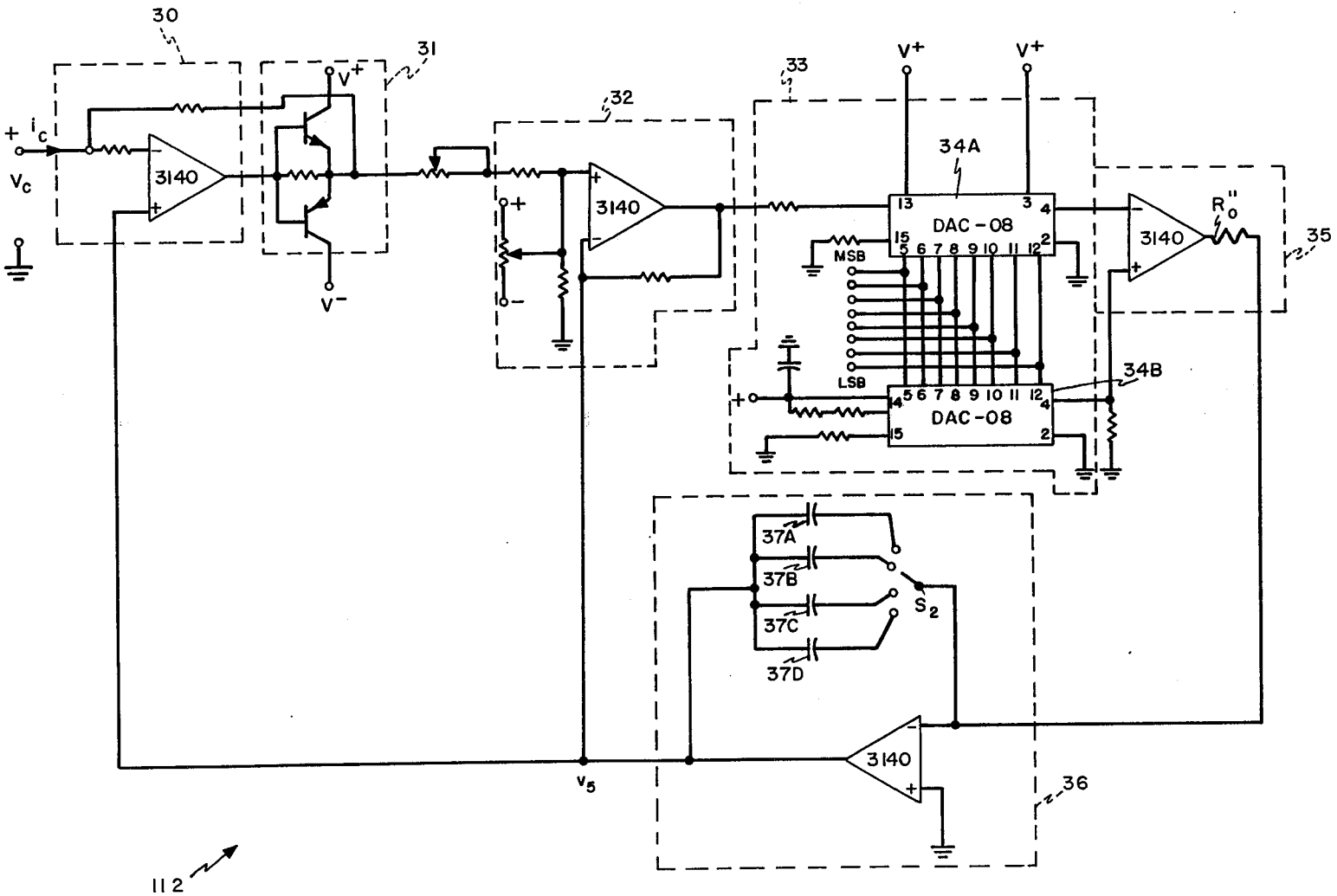
FIG. 5B is a schematic representation of the synthetic capacitor of FIG. 5A.

The circuitry labeled 112 in FIGS. 5A and 5B is a synthetic capacitor. The synthetic capacitor labeled 112 in FIGS. 5A and 5B operates in a manner similar to the simulated inductor circuit above discussed. The capacitance value C of the synthetic capacitor 112 is varied from the computer 102 in FIG. 1 by varying two circuit elements in the model, an equivalent capacitance $C_o'$ and an equivalent resistor $R_o'''$. The equivalent capacitance $C_o'$ is formed by the capacitors marked 37A–37D in FIG. 5B, which are switched into and out of the circuit by a switch $S_2$ under the control of the computer 102 in FIG. 1; the resistance $R_o'''$ is formed by a fixed resistor $R_o''$ preceded by a pair 33 of multiplying digital-to-analog converter (DACs) 34A and 34B. The DACs 34A and 34B function as digitally programmable attenuators.

FIG. 5A illustrates the functional block diagram of the digitally programmable capacitor model 112. A current-to-voltage converter 30 presents almost zero load impedance to ground and provides an output voltage proportional to the input current labeled $i_C$. The purpose of current booster 31 is to increase the operating current range of the module 112. A differential amplifier 32 and an integrator 36 are identical respectively to the elements 43 and 44 in FIG. 4A. The DACs 34A and 34B are programmed by the computer 102 in FIG. 1 to produce an output current which is transformed to a voltage by the differential current-to-voltage converter 35. The connection of functional blocks shown in FIG. 5A produces a relationship between terminal current $i_C$ and terminal voltage $V_C$, given by $$V_C = \frac{1}{C} \int i_C \, dt \tag{6}$$

as required for a capacitor. The blocks in FIG. 5A are detailed in FIG. 5B which is a self-explanatory schematic diagram of the synthetic capacitor 112.

Parity Simulator Thyristor (SCR) Model

Figure 6A:
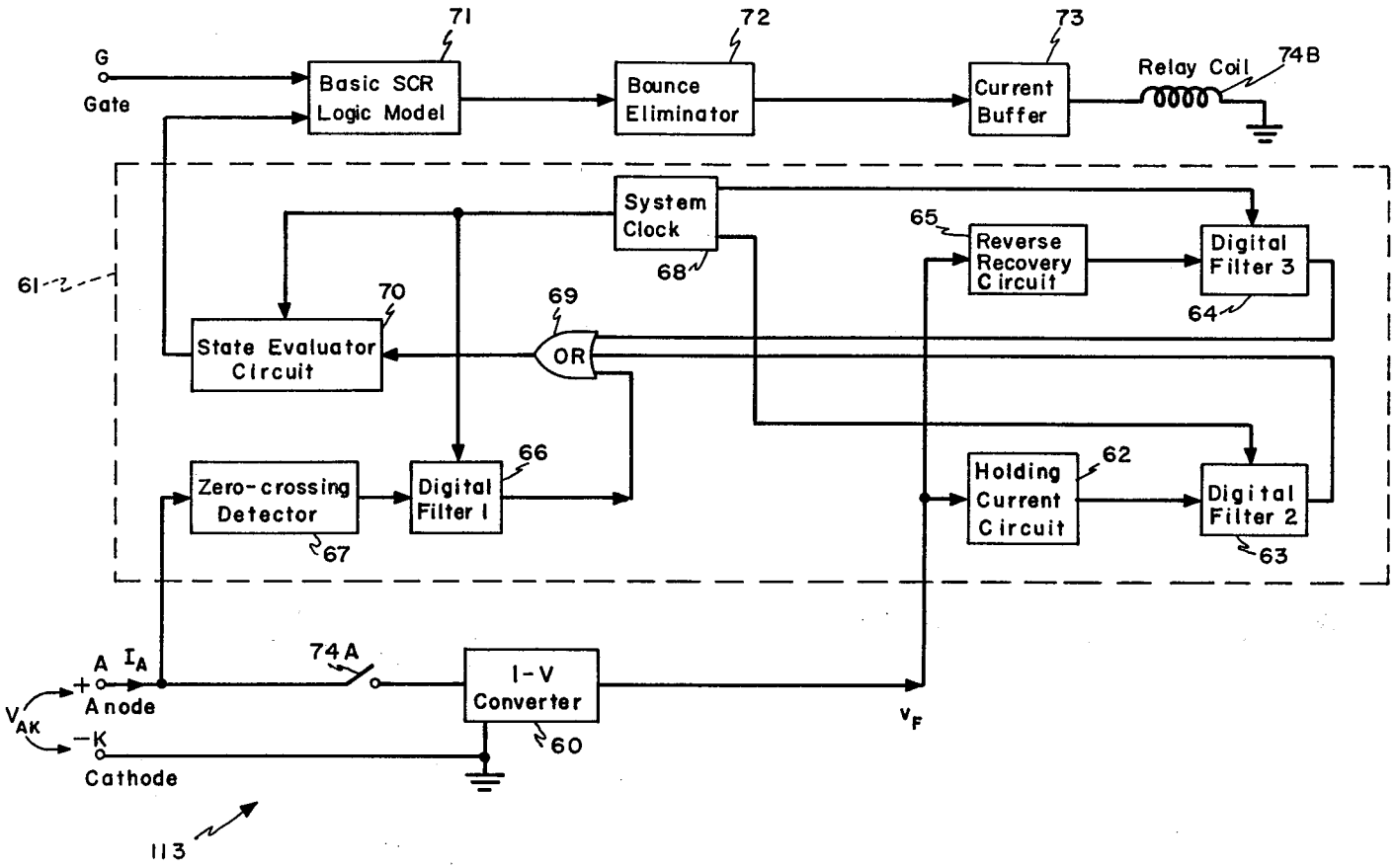
FIG. 6A is a diagrammatic representation of a synthetic thyristor.

FIG. 6A is a functional block diagram of a synthetic thyristor (SCR) 113. The switching action of the thyristor is performed by a reed relay whose contacts are marked 74A and whose relay coil is marked 74B. The state of the relay 74A–74B, i.e., open or closed, is determined by an evaluation of electrical conditions at its anode A, cathode K and gate G terminals. The evaluation is performed by the remaining blocks depicted in FIG. 6A. Their operation is discussed below.

Assuming the SCR 113 is "on", i.e., the relay 74A–74B is closed, an I–V converter 60 produces a voltage $V_F$ proportional to anode current $I_A$ of the SCR 113. A holding current circuit 62 determines whether the current $I_A$ is large enough for the SCR to remain "on". If so, a signal is sent via an OR gate 69 to a state evaluator circuit 70 which, in turn, sends a signal appropriate to keep the SCR "on" to a basic SCR logic model 71.

A reverse recovery circuit 65 permits the current $I_A$ to reverse sign momentarily before informing the basic SCR logic model 71 (via the OR gate 69 and state evaluator circuit 70) that the SCR 113 should turn "off", with the subsequent opening of the relay 74A–74B.

If the SCR 113 is in the "off" condition, i.e., the relay 74A–74B is open, it cannot turn "on" until two conditions are met simultaneously: $V_{AK}>0$ (where $V_{AK}$ is the forward bias voltage of the SCR 113) and the presence of a signal at the gate terminal G. The first condition is conveyed to the basic SCR logic model 71 through the OR-gate 69 and the state evaluator circuit 70. The second condition is conveyed directly to the SCR logic model 71 from the gate terminal G.

Figure 6B:
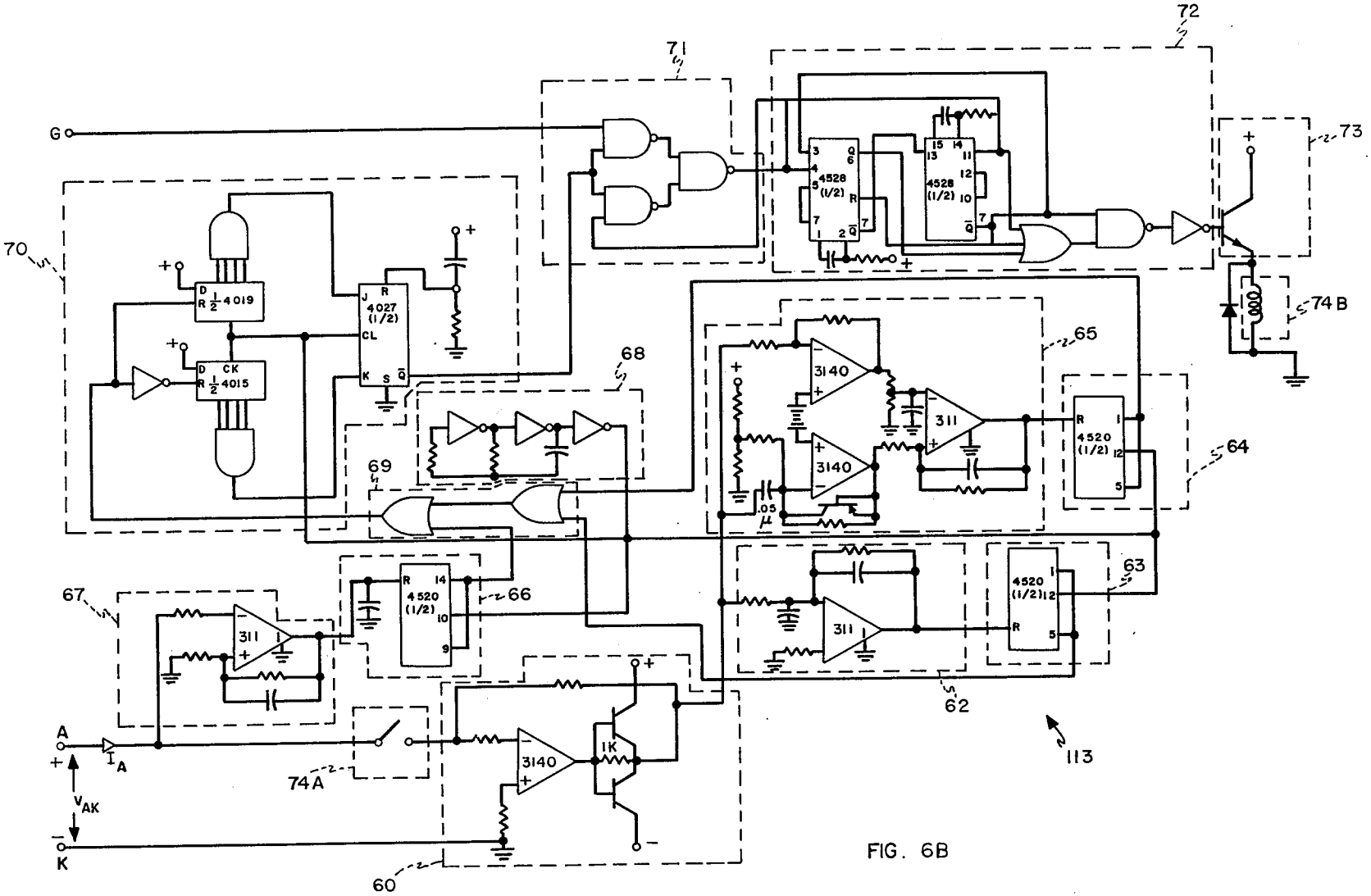
FIG. 6B is a schematic representation of the synthetic thyristor of FIG. 6A.

The synthetic SCR 113 uses digital circuits with timing pulses being supplied by a system clock 68. Digital filters 63, 64 and 66 provide noise immunity during switching operations. A bounce eliminator 72 causes a halt in system operation until the mechanical contacts 74A have stopped bouncing. A current buffer 73 provides current drive for the relay coil 74B. The blocks in FIG. 6A are detailed in FIG. 6B which is a self-explanatory schematic diagram of the synthetic thyristor 113.

Figure 7A:
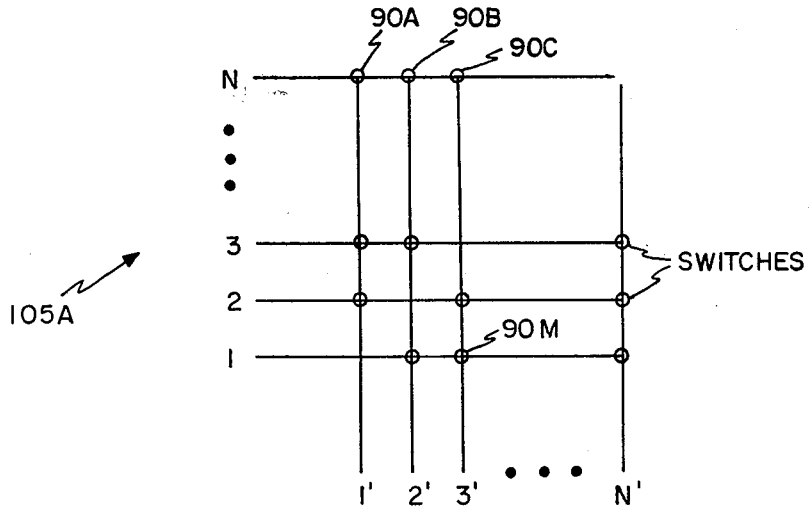
FIGS. 7A and 7B are two forms of switching matrices that may be used in the parity simulator of FIG. 1.
Figure 7B:
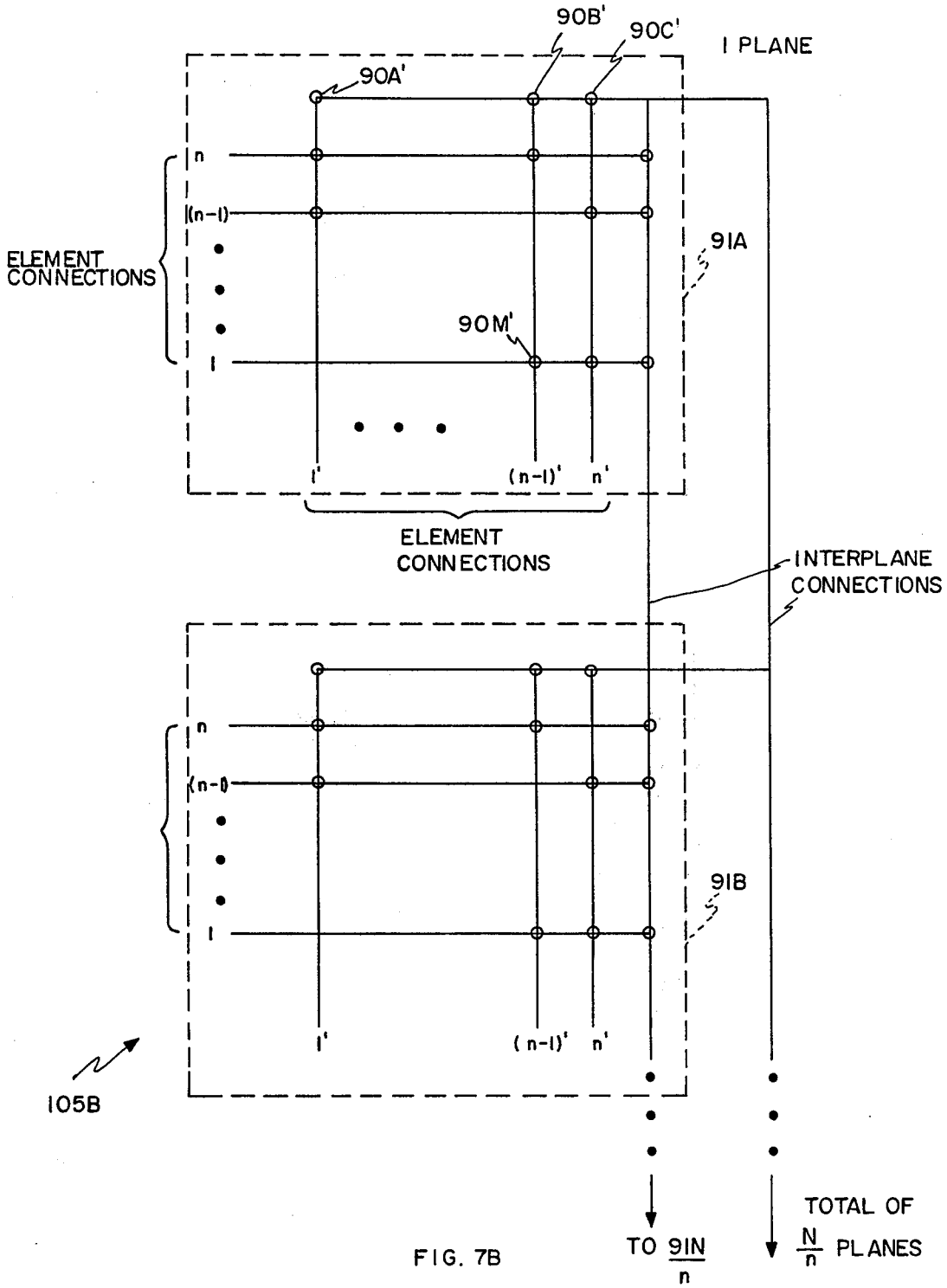

The switching matrix 105 in FIG. 1 may be the switching matrix labeled 105A in FIG. 7A, but a preferred switching matrix is that shown at 105B in FIG. 7B. In both matrices, the switches are the circles marked 90A . . . 90M . . . and 90A' . . . 90M' . . . , respectively.

The general problem of automatically interconnecting N two terminal elements in every possible way can be solved in a conceptually straightforward manner by means of an N×N switching matrix, (i.e., the matrix 105A in FIG. 7A). This solutiion requires $(N\times N)-N=N^2-N$ switches (which differs from $N^2$ because no switches are required on the matrix diagonal). If N=100, which is realistic for the subject simulator, then 9,900 switches are required. This large number presents economic as well as practical implementation problems.

Since the element interconnections produce electrical networks, it is unnecessary to provide for every possible interconnection of N elements. The reason for this is that certain element connections do not result in practical electrical circuits. By partitioning, or dividing, the N×N matrix into n submatrices or planes, (i.e., the submatrices or planes designated 91A, 91B . . . $\mathbf{91}_{(N/n)}$, FIG. 7B) of size N/n, some interconnection flexibility is lost but the number of switches is reduced by a factor of approximately 1/n. For the example above, this means that if ten 10×10 submatrices were used, instead of a single 100×100 matrix, only 900 switches would be required.

The mix of elements made available on each submatrix or plane is important to the successful implementation ofthis partitioned matrix concept. Since interconnections among the submatrices require switches in addition to the 900 calculated above, the number of such interconnections must be kept to a minimum. The mix of elements in a plane, therefore, must be such that most element interconnections are made within planes, thereby minimizing interplane connections.

A further reduction in interplane connections can be effected by carefully choosing which model elements will represent specific elements in the circuit being studied. For instance, there may be six capacitor models available in the parity simulator, spread perhaps over four planes, any one of which could represent a specific capacitor in the modeled system. The use of one in particular, however, might require fewer interplane connections than the others. Optimizing element selection with respect to minimum interplane connections is a difficult task which must be performed by the digital computer. The computer algorithm takes the entire circuit as it is presented by the investigator through the CRT/keyboard terminal 103 in FIG. 1 and performs an iterative analysis of the possible interconnections before actuating the appropriate switches in the sub-matrices. The result is a minimization of interplane connections.

A few further comments of a general nature are contained in this paragraph. The computer 102 in FIG. 1 serves to acquire, process and display data from a plurality of synthetic elements (such as, for example, the synthetic elements 111, 112 and 113 above) appropriately interconnected to provide a model of an electrical network to be analyzed. The computer 102 serves, as well, to automatically modify parameters within the various synthetic elements and/or interconnections of the synthetic elements to optimize electrical network designs, for example, with respect to the various operational characteristic (e.g., harmonics, frequency response, efficiency, voltage levels, and so forth) of the network.

Further modifications of the invention herein disclosed will occur to persons skilled in the art and all such modifications are deemed to be within the spirit and scope of the invention as defined by the appended claims.

What is claimed is:

1. A simulator for modeling an electrical network that comprises, in combination:

a plurality of synthetic electrical elements interconnected to simulate the electrical network, said synthetic elements having electrical terminals and having physical voltages between terminals and physical currents flowing through the terminals that correspond respectively to scaled values of actual physical terminal voltages and scaled values of actual physical terminal currents in said electrical network, the synthetic elements being interconnected to produce a model which is topologically equivalent to the modeled network.

2. A simulator as claimed in claim 1 wherein each synthetic element of said plurality of synthetic electrical elements has its own isolated electrical power supply, allowing said synthetic elements to be interconnected without regard for a common ground.

3. A simulator as claimed in claim 2 in which the voltages, currents and frequencies existing in the network to be simulated can be scaled by predetermined factors in the simulation.

4. A simulator as claimed in claim 1 wherein the principal operational components of the synthetic electrical elements are active electronic devices.

5. A simulator as claimed in claim 4 wherein said active electronic devices include operational amplifiers, transistors and voltage regulators.

6. A simulator as claimed in claim 5 wherein the active electronic devices further include multiplying digital-to-analog converters.

7. A simulator as claimed in claim 6 wherein the multiplying digital-to-analog converters serve to establish the values of said synthetic elements.

8. A simulator as claimed in claim 6 that further includes manual switch means to establish the states of the multiplying digital to analog converters, thereby establishing the value of each synthetic element.

9. A simulator as claimed in claim 6 having a digital computer connected to establish the states of the multiplying digital-to-analog converters to establish the values of each synthetic element.

10. A simulator as claimed in claim 9 in which the digital computer serves to introduce time dependency of synthetic element parameters.

11. A simulator as claimed in claim 9 in which the digital computer serves to introduce non-linearities into the synthetic element electrical characteristics.

12. A simulator as claimed in claim 1 having a digital computer connected to interconnect the synthetic elements.

13. A simulator as claimed in claim 12 having switching matrix means connected between the digital computer and the synthetic elements to provide for digital control of synthetic element interconnections.

14. A simulator as claimed in claim 13 in which the switching matrix means comprises a plurality of sub-matrices designed to minimize the required number of switches needed in said digital control.

15. A simulator as claimed in claim 14 wherein each sub-matrix of said plurality of sub-matrices interconnects a set of synthetic elements which are pre-selected on the basis of their frequency of use together and provides minimization of connections between sub-matrices, said sub-matrices being adapted to interconnect with one another, said digital computer being programmed to effect intelligent interconnection of the synthetic elements within each sub-matrix and the interconnection of sub-matrices to one another.

16. A simulator as claimed in claim 1 having a digital computer operable to acquire, process and display data from the plurality of synthetic elements interconnected to provide a model of said network.

17. A simulator as claimed in claim 1 having a digital computer operable to automatically modify parameters and interconnections of the synthetic element to optimize electrical network designs with respect to the various operational characteristics of said network.

18. A simulator for modeling the power circuit part of a static power conversion system including semiconductor switches, that comprises, in combination: a plurality of synthetic electrical elements interconnected to simulate said power circuit part of a static power conversion system that includes semiconductor switches, said elements having electrical terminals and having, in an operating simulator, physical terminal voltages and physical terminal currents that correspond respectively to scaled values of the actual physical terminal voltages and the actual physical terminal currents of the modeled power circuit part of the static conversion system, the synthetic electrical elements being interconnected to produce a model which is topologically equivalent to the modeled network, each synthetic electric element of said plurality having its own isolated electrical power supply so that the synthetic elements can be interconnected without regard for common ground.

19. A simulator for modeling an electrical network, that comprises in combination, a plurality of synthetic electrical elements having electrical terminal means as part of each synthetic electrical element, there being, in an operative simulator, physical voltages between terminals of the terminal means and physical currents flowing through said terminals that correspond on a one to one basis respectively to scaled values of the actual physical terminal voltages and the actual physical terminal currents in said the electrical network, the synthetic elements being interconnected to produce a model which is topologically equal to the modeled network.

20. A simulator for modeling an electrical network, that comprises, in combination: a plurality of synthetic electrical elements having electrical terminal means comprising a plurality of terminals, each synthetic element being operable to provide voltages between said terminals that correspond to scaled values of the actual terminal voltages of the modeled network and currents through said terminals that correspond to scaled values of the actual terminal currents of the modeled network; and means for interconnecting the synthetic electrical elements to provide a model that is topologically equal to the modeled network.

* * * * *